US008966834B2

(12) United States Patent
Sladojevic

(10) Patent No.: US 8,966,834 B2
(45) Date of Patent: Mar. 3, 2015

(54) CONCRETE LIFTING ANCHORS

(76) Inventor: Robert Sladojevic, Cherry Gardens (AU)

( * ) Notice: Subject to any disclaimer, the term of this patent is extended or adjusted under 35 U.S.C. 154(b) by 0 days.

(21) Appl. No.: 13/806,205

(22) PCT Filed: Jun. 30, 2010

(86) PCT No.: PCT/AU2010/000833
§ 371 (c)(1),
(2), (4) Date: Dec. 21, 2012

(87) PCT Pub. No.: WO2011/006190
PCT Pub. Date: Jan. 20, 2011

(65) Prior Publication Data

US 2013/0097945 A1 Apr. 25, 2013

(30) Foreign Application Priority Data

Jul. 17, 2009 (AU) ..... 2009903354

(51) Int. Cl.

| | |
|---|---|
| ***E02D 35/00*** | (2006.01) |
| ***E04G 21/14*** | (2006.01) |
| ***E04H 12/34*** | (2006.01) |
| ***B66C 1/66*** | (2006.01) |
| ***B66C 1/30*** | (2006.01) |
| ***E04C 5/12*** | (2006.01) |
| ***E04C 5/16*** | (2006.01) |
| ***E04C 5/18*** | (2006.01) |

(52) U.S. Cl.
CPC . *B66C 1/666* (2013.01); *B66C 1/30* (2013.01); *E04C 5/12* (2013.01); *E04C 5/16* (2013.01); *E04C 5/18* (2013.01); *E04G 21/142* (2013.01)
USPC ..... 52/125.5; 52/124.2; 52/712

(58) Field of Classification Search
CPC ..... B66C 1/666; E04G 21/147; E04B 1/41
USPC ..... 52/124.2–125.5, 586, 712, 715, 698, 52/714
See application file for complete search history.

(56) References Cited

U.S. PATENT DOCUMENTS

| | | | | |
|---|---|---|---|---|
| 4,627,198 | A * | 12/1986 | Francies, III | 52/125.5 |
| 5,596,846 | A | 1/1997 | Kelly | |
| 5,899,043 | A * | 5/1999 | Reay | 52/707 |
| 6,185,897 | B1 * | 2/2001 | Johnson et al. | 52/583.1 |
| 6,502,362 | B1 * | 1/2003 | Zambelli et al. | 52/698 |
| 6,694,680 | B2 * | 2/2004 | Zambelli et al. | 52/125.2 |
| 2004/0159070 | A1 | 8/2004 | Hansort | |
| 2013/0091785 | A1 * | 4/2013 | Sladojevic | 52/125.4 |

FOREIGN PATENT DOCUMENTS

| | | |
|---|---|---|
| WO | 2008001206 | 1/2008 |

* cited by examiner

*Primary Examiner* — Brian Glessner
*Assistant Examiner* — Brian D Mattei

(57) ABSTRACT

A shear bar for an edge lift anchor for a concrete panel, the shear bar being a bar of rectangular cross-section shaped to engage an upper edge of the lifting anchor when installed in the panel, the bar having opposed large area faces and opposed smaller area faces and the bar being so shaped that when engaged with the upper edge of the lifting anchor one of its opposed large area faces will face towards the upper surface of the panel in the casting configuration of the panel.

1 Claim, 11 Drawing Sheets

CONCRETE LIFTING ANCHORS

The present invention relates to anchors for use in the lifting of cast concrete products such as wall panels during the erection thereof. More particularly the invention relates to shear bars for use with edge lift anchors.

In the fabrication of precast concrete wall panels either at an offsite casting yard or onsite, it is necessary to lift the panel from the horizontal configuration in which it is cast to a vertical configuration for transportation and/or erection. For offsite casting and for some onsite casting, lifting of the panel takes place from the edge of the panel which is the upper edge in the erected condition of the panel. For this purpose so-called edge lift anchors are incorporated into the reinforcing structure of the panel prior to casting. During casting the head of the anchor is encased within a removable or disposable void former to form within the edge surface of the panel a recess within which the head of the anchor lies for releasable coupling to lifting equipment.

Various forms of edge lift anchor are currently available. At the commencement of edge lifting when the panel is in its horizontal configuration following casting, the anchor is subject to a substantial shear loading in a direction transverse to the upper face of the panel. In order to resist that shear loading, the anchor is associated with a shear bar which engages the upper edge of the anchor body. Conventionally, the shear bar is formed from a length of reinforcing bar, and thereby of round cross-section appropriately bent to overlie the upper edge of the body of the anchor and to extend further into the depth of the panel. The shear bar must be of an adequate size to carry and distribute the loading. The governing factor in determining the required diameter for the shear bar is its shear capacity which has to exceed the tensile load capacity of the concrete surrounding the lift anchor. The present inventor has determined that a difficulty which arises with conventional shear bars of round cross-section is that as a result of the cross-sectional shape and the manner in which a bar of that cross-sectional shape can be bent, the contact between the shear bar and the upper edge of the anchor body is over a very small area of the shear bar, almost a point loading. Unless the shear bar is of a sufficient cross-section, it can deform under that point loading thereby permitting vertical movement of the anchor within the concrete resulting in stress fractures in the top face of the panel. To avoid deformation of the shear bar there is a tendency to use shear bars of a greater diameter than would otherwise be necessary having regard to the normal shear capacity of the bar.

Contrary to this, the present inventor has realised that the use of a shear bar of flat (rectangular) cross-section rather than round cross-section is able to provide a greater surface area of contact between the shear bar and the anchor and hence for a given shear resistance the required cross-sectional area of a shear bar of flat cross-section will be less than that required for a shear bar of round cross-section.

According to the present invention there is provided a shear bar for an edge lift anchor for a concrete panel, the shear bar being a bar of rectangular cross-section shaped to engage an upper edge of the lifting anchor when installed in the panel, the bar having opposed large area faces and opposed smaller area faces and the bar being so shaped that when engaged with the upper edge of the lifting anchor one of its opposed large area faces will face towards the upper surface of the panel in the casting configuration of the panel.

In preferred embodiments of the invention, the shear bar has a central portion adapted to engage an upper edge of the anchor and, at each side of the central portion, a first portion which extends downwardly from the central portion, and a second portion which extends outwardly from the first portion. The first portion may be inclined downwardly and outwardly, or may extend substantially vertically downwardly. It may extend to a level corresponding to a lower edge of the anchor or to an intermediate level between the upper and lower edges and corresponding to a neutral zone of the panel. The second portion extending outwardly from the first portion may be directed horizontally, or may be inclined upwardly and outwardly. When extending horizontally, the second portion may lead into a third portion inclining upwardly and outwardly, and when the second portion inclines outwardly and upwardly it may extend into a third portion extending substantially horizontally.

The present invention also provides a lift anchor with a shear bar as defined above applied thereto, the shear bar having a central portion engaging a planar portion of the upper edge of the anchor.

Embodiments of the invention will now be described by way of example only with reference to the accompanying drawings in which.

Figure 1:
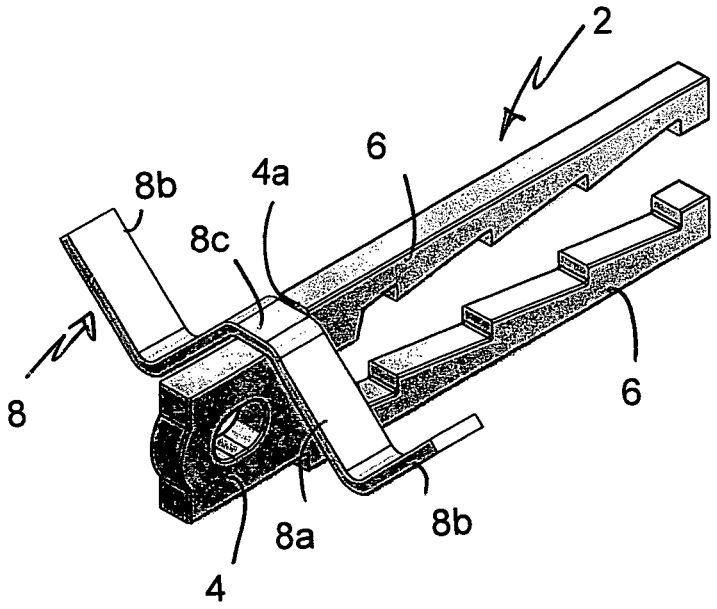
FIG. 1 is a perspective view showing an edge lift anchor having a shear bar of flat section installed thereon.
Figure 2:
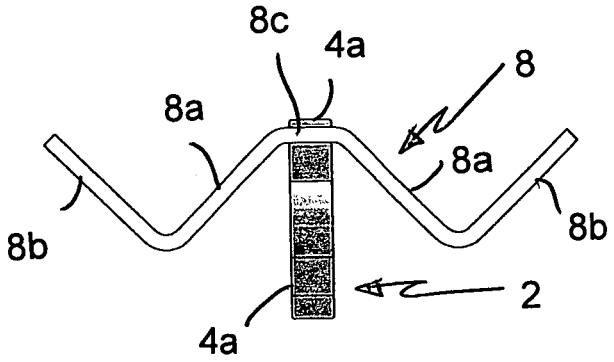
FIG. 2 is a front view.
Figure 3:
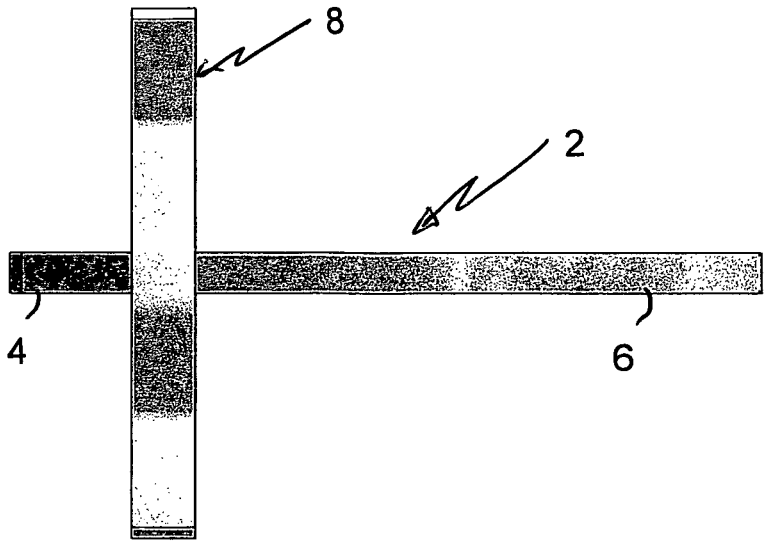
FIG. 3 is a plan view.

FIGS. 1 to 4 show an edge lift anchor 2 in its installed position for lifting of the panel from its casting configuration in which the upper face of the panel is horizontal. The anchor has a head 4 for coupling to lifting apparatus, and an anchoring portion in the form of a pair of substantially parallel legs 6 extending from the head 4. The particular head 4 shown is designed for cooperation with a lifting clutch in the form of a ring clutch and an arcuate locking bolt received within the eye of the head, although it is to be understood that the head could be of a different detailed design for use with other types of lifting apparatus. The legs 6 are profiled along their inner edges with a saw tooth profile so as to lock into the surrounding concrete but it is to be understood that the legs may have any other form of profile to achieve that purpose and the anchoring portion may be even be of a form which does not use two parallel legs.

The anchor of the general type shown with parallel legs or of other forms without parallel legs is formed from thick metal plate by cutting and/or pressing techniques as will be well understood by persons skilled in the art. It is orientated in the panel in its casting configuration with an upper edge substantially parallel to the upper face of the panel. In the embodiment shown, the head 4 of the anchor is stepped inwardly relative to the anchoring portion, the step being designated 4*a* in the drawings. A metal shear bar 8 of flat cross-section engages the upper edge of the head 4 adjacent the step 4*a* as is clearly shown in FIGS. 1 and 4. The shear bar 8 in this embodiment is shaped to extend across the upper edge of the head 4 and then extends downwardly at each side of the head 4 to form downwardly-inclined portions 8*a* embedded more deeply within the thickness of the panel. The outer portions 8*b* of the bar are then bent back upwardly to define return portions.

The use of a flat bar as the shear bar provides large area contact between the underside of the bar in its central zone 8*c* and the upper edge of the anchor head 2 which is substantially planar in the zone of engagement by the shear bar. As a result, there is no localised or concentrated loading on the shear bar as discussed earlier in relation to conventional shear bars of round cross-section. As a result the loading is spread over the entire surface of the bar and shear resistance is obtained from the full cross-section of the bar, unlike the situation which arises with shear bars of round cross-section. The upwardly directed portions 8*b* wedge or lock the shear bar into the concrete whereby the bar utilises its full shear and tensile strength in the anchoring action. Absent those upwardly directed return portions, the principal resistance holding the shear bar into the concrete when upward load is applied is the actual frictional bond strength between the shear bar and concrete which is far less than the actual tensile or shear capacity of the shear bar. However, while the presence of the upwardly directed return portions 8*b* is preferred, it is not essential to the basic concept, and the shear bar can be alternatively configured to provide an effective action as will be described for example with reference to FIGS. 5 and 6.

The use of flat bar of this form with its large area surface facing upwardly to the upper face of the panel provides a large surface area which is better able to carry the shear loading than an equivalent shear bar of round cross-section. In particular it provides a significantly wider conical failure zone above the shear bar that is provided by an equivalent bar of round cross-section and as such it permits the panel to be lifted at lower part-cured strengths than is possible with a round shear bar. It will also be appreciated that a shear bar of round cross-section will, in its central zone adjacent the upper edge of the anchor, sit higher in the concrete as a result of the manner in which it is bent; in other words it will sit closer to the upper surface than will the flat shear bar. Accordingly, with a round shear bar the thickness or depth of the concrete above the shear bar is reduced which also results in a reduction in its capacity. The flat shear bar sits lower and deeper in the concrete and the increased depth also results in a larger conical failure zone and as such the concrete itself offers far greater resistance to the shear bar from pulling out.

In addition to enabling the panel to be lifted at lower part-cured strengths, the flat shear bar is also better suited for use with thin panels as a result of the larger conical failure zone associated with the bar.

It will be appreciated that the quantity of metal required to form the flat bar would be significantly less than that required for a shear bar of round cross-section of equivalent capacity thereby resulting in significant cost reductions.

Although in the embodiment, shown the head of the anchor is stepped to provide location for the shear bar, in an alternative the edge of the anchor can be provided with a recess of rectangular cross-section at the base of the head portion to receive and locate the flat shear bar.

FIGS. 5 to 22 show the flat shear bar 8 bent into a number of different configurations.

Figure 4:
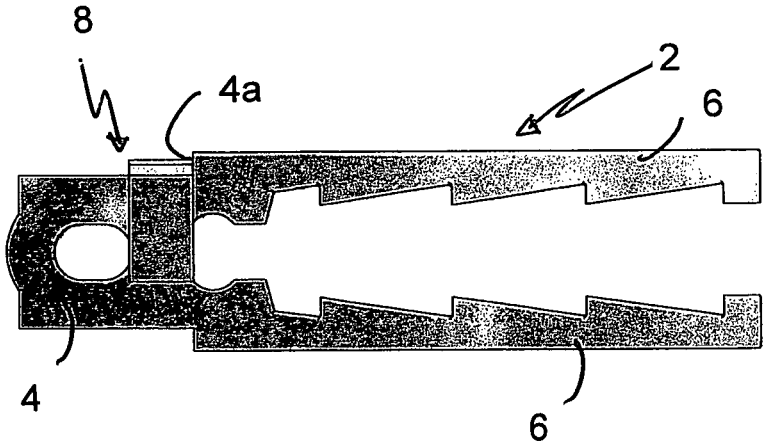
FIG. 4 is a side view.
Figure 5:
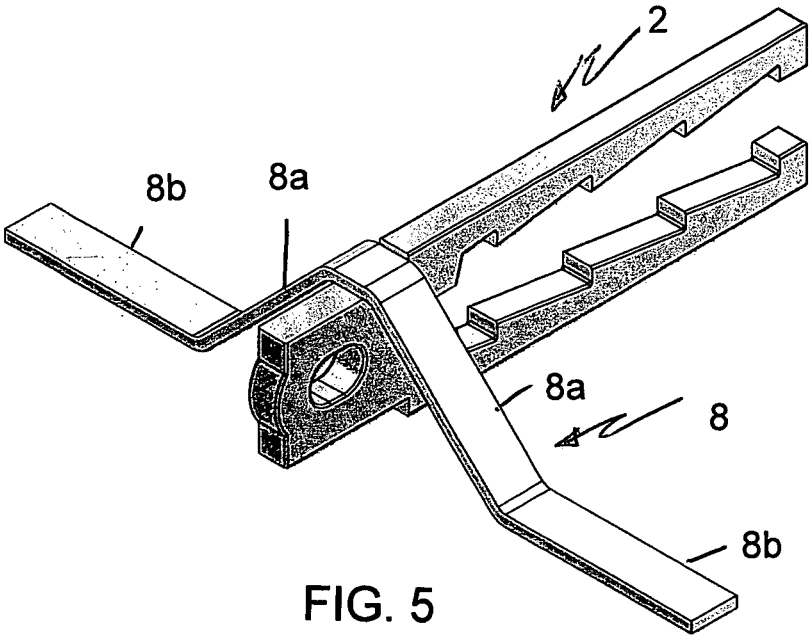
FIG. 5 is a view similar to FIG. 1 but having a shear bar formed to a different configuration.
Figure 6:
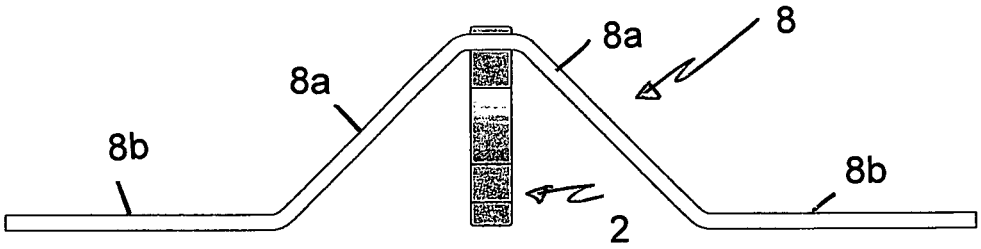
FIG. 6 is an end view.

In FIGS. 5 and 6, downwardly-inclined portions 8*a* of the bar extend to the level of the lower edge of the anchor and portions 8*b* extend horizontally outwardly parallel to the face of the panel. This configuration provides a greater embedment depth than that of the configuration of FIGS. 1 to 4 and also a greater area of concrete above the shear bar.

Figure 7:
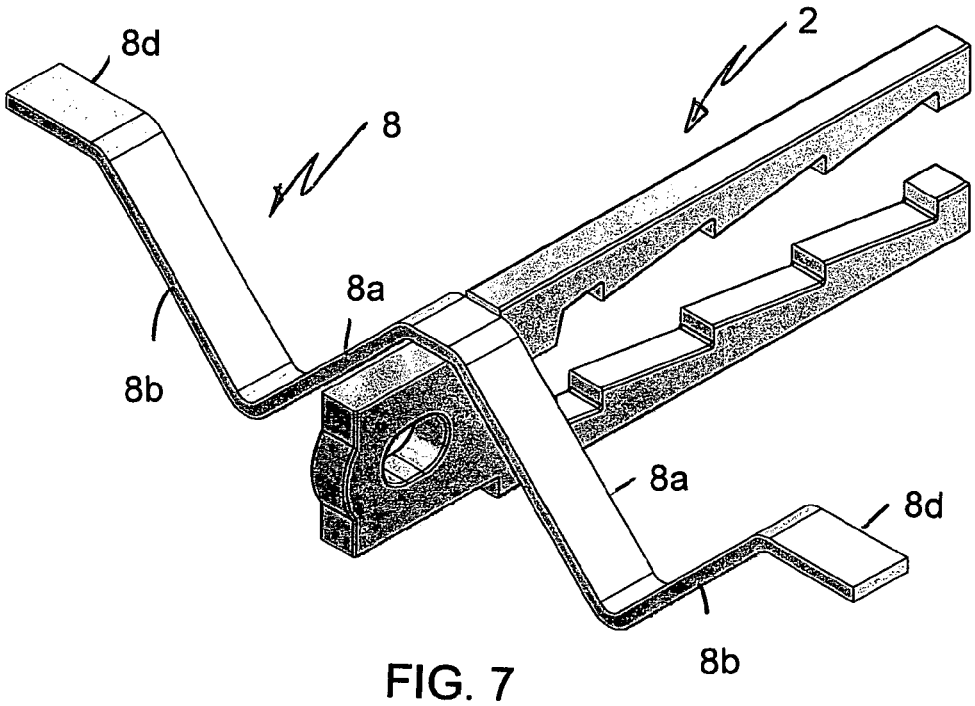
FIG. 7 is a view similar to FIG. 1 but with the shear bar formed to a different configuration.
Figure 8:
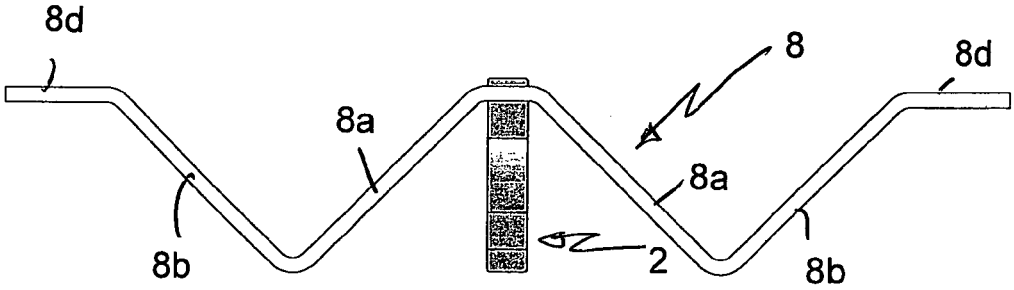
FIG. 8 is an end view.

In FIGS. 7 and 8, portions 8*a* extend downwardly to the level of the lower edge of the anchor to obtain maximum embedment depth within the concrete and portions 8*b* are upwardly directed to provide a wedging action equivalent to that discussed in relation to FIGS. 1 and 4, the portions 8*b* terminating in horizontally directed outer portions 8*d*.

Figure 9:
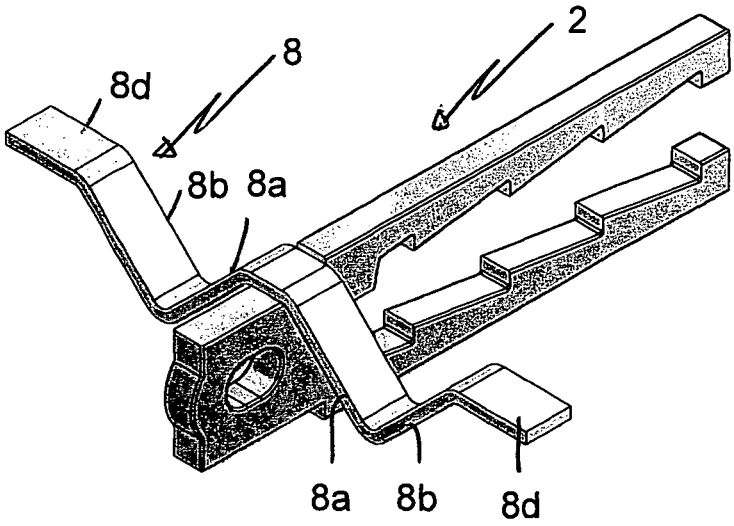
FIG. 9 is a view similar to FIG. 1 but having a shear bar formed to a different configuration.
Figure 10:
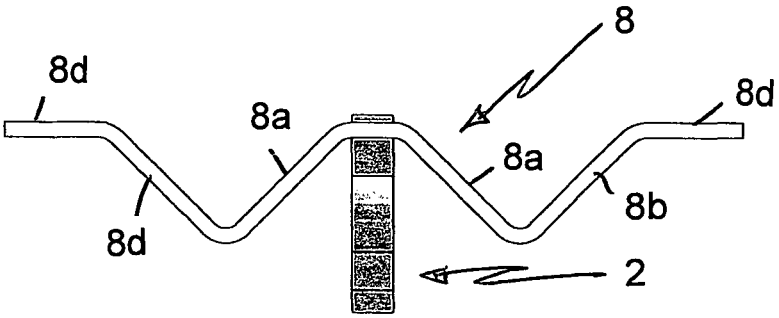
FIG. 10 is an end view.

FIGS. 9 and 10 show a similar configuration to that of FIGS. 7 and 8 except that the portions 8*a* only extend to the depth of the mid point of the anchor which corresponds to the neutral zone of the panel. The neutral zone is subject to the least stress within the concrete and may provide an optimal embedment position.

Figure 11:
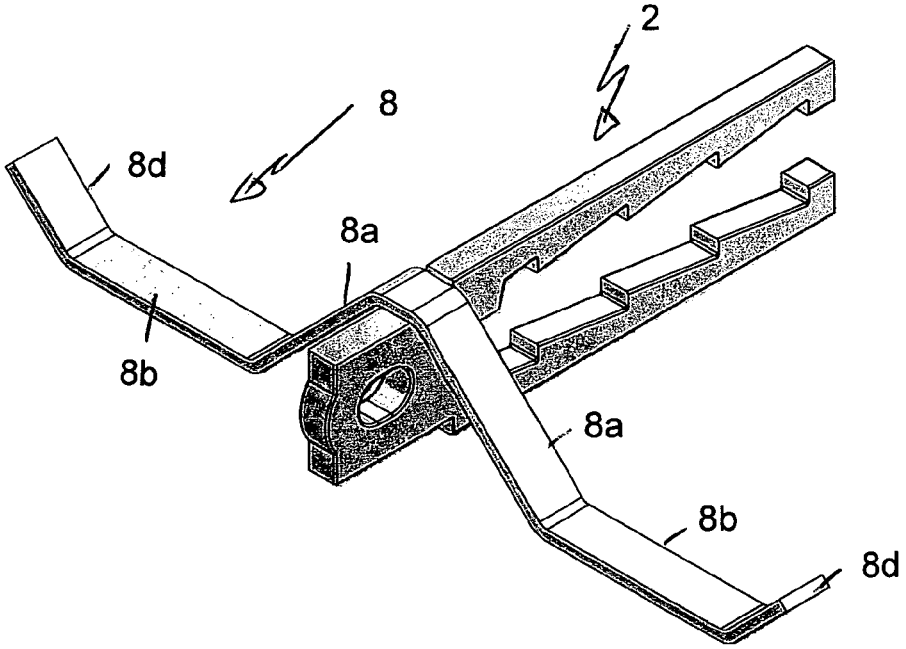
FIG. 11 is a view similar to FIG. 1 but having a shear bar formed to a different configuration.
Figure 12:
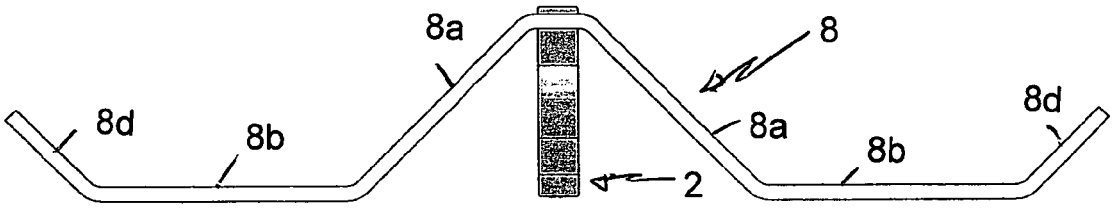
FIG. 12 is an end view.

FIGS. 11 and 12 show a variant of FIGS. 7 and 8 in which portions 8*b* extend horizontally to provide a large flat area at the lower level, with outer portions 8*d* inclined upwardly to provide the wedging action.

Figure 13:
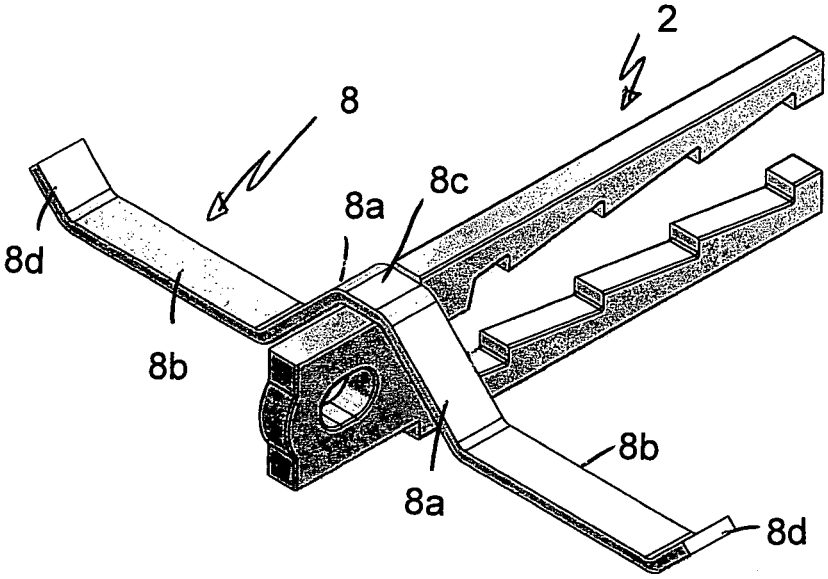
FIG. 13 is a view similar to FIG. 1 but having a shear bar formed to a different configuration.
Figure 14:
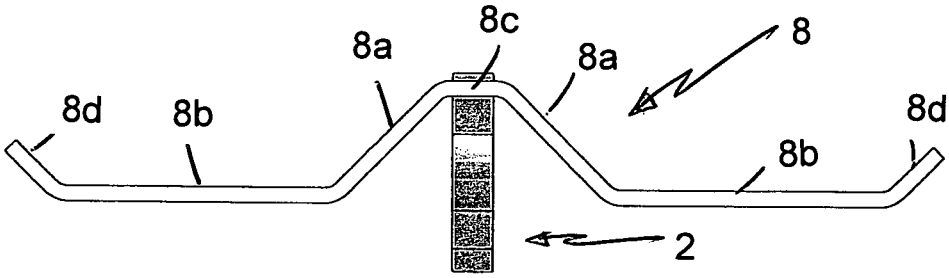
FIG. 14 is an end view.

FIGS. 13 and 14 show a configuration similar to that of FIGS. 11 and 12 but based on the concept shown in FIGS. 9 and 10 in which portions 8*a* extend downwardly to the level of the neutral zone.

Figure 15:
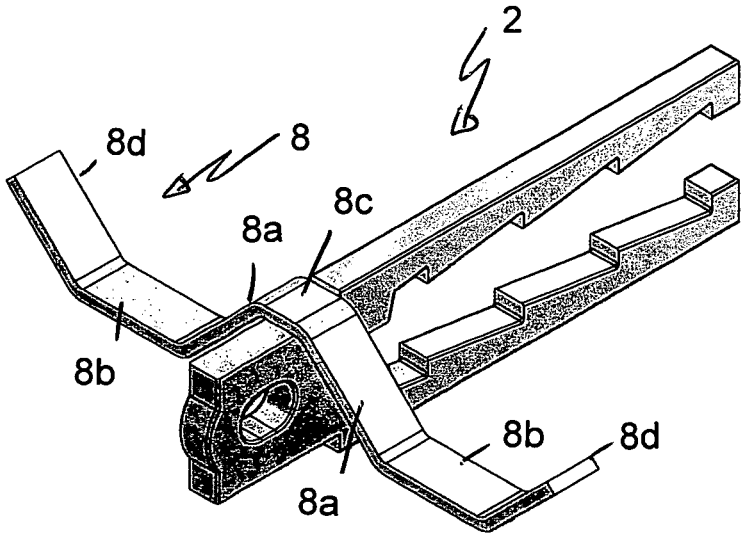
FIG. 15 is a view similar to FIG. 1 but having a shear bar formed to a different configuration.
Figure 16:
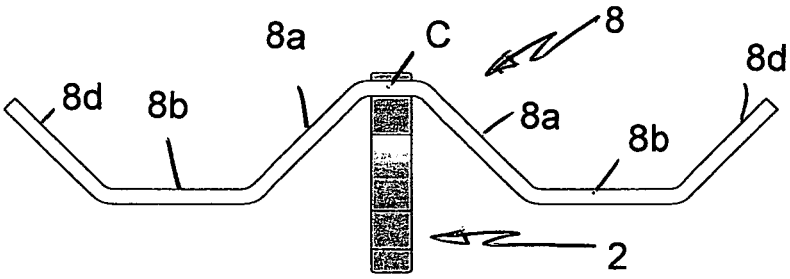
FIG. 16 is an end view.

FIGS. 15 and 16 show a variant of FIGS. 13 and 14 in which the portions 8*b* are of reduced length, with the outer portions 8*d* being of increased length to extend to the level of the central zone 8*c* of the shear bar.

Figure 17:
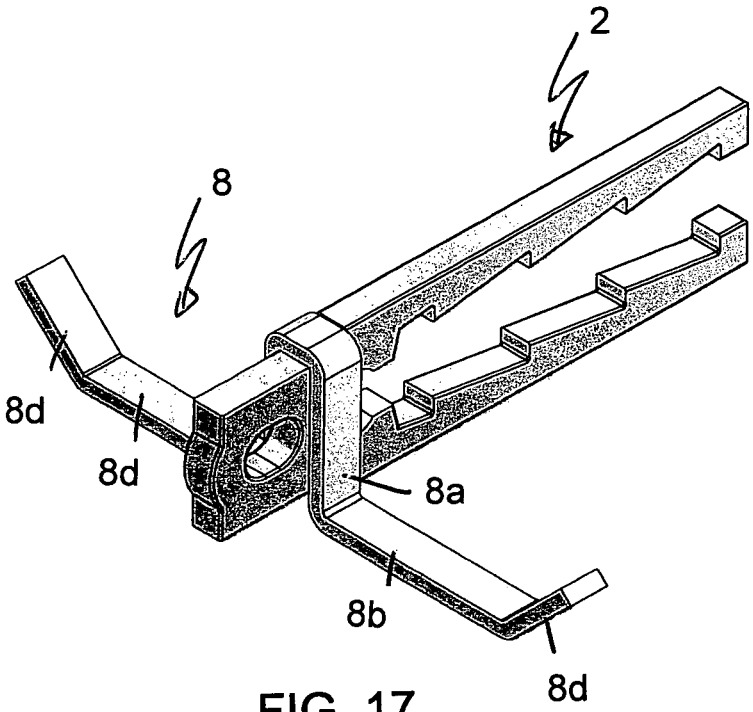
FIG. 17 is a view similar to FIG. 1 but having a shear bar formed to a different configuration.
Figure 18:
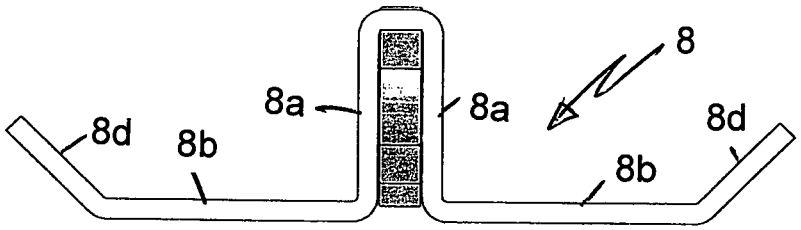
FIG. 18 is an end view.
Figure 19:
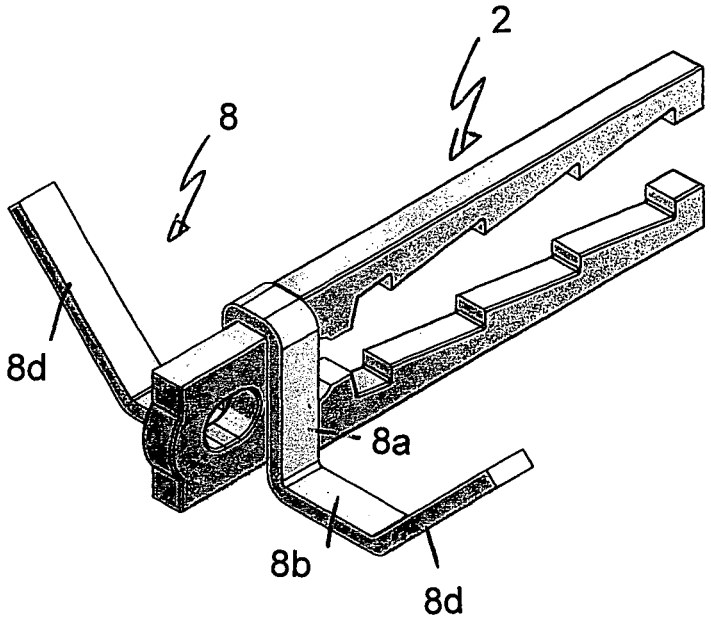
FIG. 19 is a view similar to FIG. 1 but having a shear bar formed to a different configuration.
Figure 20:
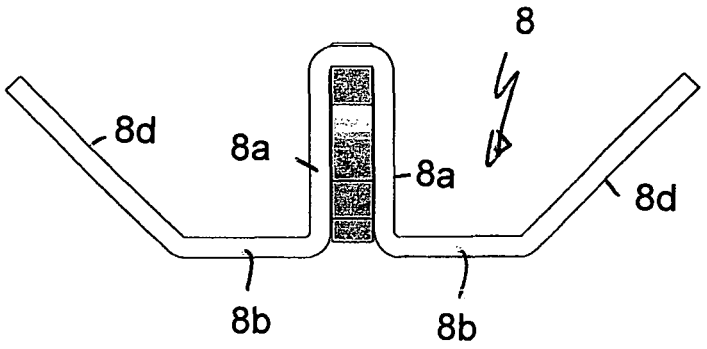
FIG. 20 is an end view.
Figure 21:
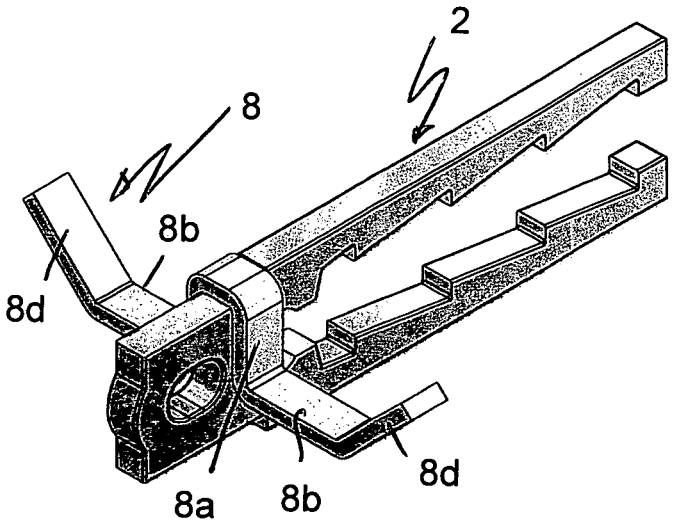
FIG. 21 is a view similar to FIG. 1 but having a shear bar formed to a different configuration.
Figure 22:
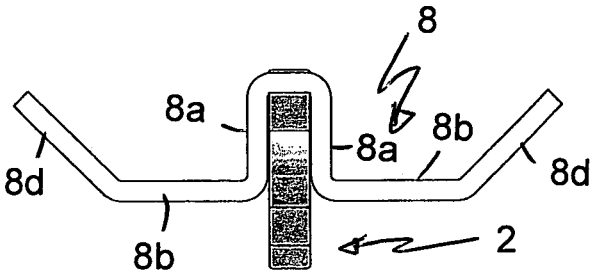
FIG. 22 is an end view.

In FIGS. 17 and 18, the portions 8*a* are directed vertically downwardly in contact with the opposite sides of the anchor head rather than being inclined as shown in the previous embodiments. It is believed that this vertical configuration of the portions 8*b* will provide the strongest resistance to vertical loading. In the other embodiments, the inclination of the portions 8*a* will, when under loading, induce a moment of force and as such the entire cross-sectional area of shear bar is not providing full tensile resistance. In contrast when these portions of the bar are vertical the resultant load on them is vertical whereby the full cross-sectional area is in tension as it is subject to no moment and as such should provide the greatest shear resistance.

FIGS. 19 and 20, and 21 and 22 show variants of the embodiment of FIGS. 17 and 18 in which the lengths of the portions 8*a*, 8*b* and 8*d* are varied to provide configurations similar to those discussed for earlier embodiments, with the important exception that the portions 8*a* are vertical and not inclined.

The embodiments are described by way of example only and modifications are possible within the scope of the invention.

The invention claimed is:

1. A shear bar for an edge lift anchor for a precast concrete wall panel, comprising;

a rectangular cross-section shaped to engage a substantially planar portion of an upper edge of an edge lift anchor when installed in a precast concrete wall panel, the shear bar having opposed large area faces and opposed smaller area faces, and the shear bar being so shaped that when engaged with an upper substantially planar edge of an edge lift anchor one of its opposed large area faces will face towards an upper surface of a precast concrete wall panel in the casting configuration of the concrete panel; the other of its opposed large area surfaces having a substantially planar surface in a central portion of the shear bar adapted to engage a substantially planar portion of an upper edge of an edge lift anchor, wherein the shear bar has a shear capacity which exceeds the tensile load capacity of the concrete surrounding an edge lift anchor when installed in a precast concrete wall panel wherein the shear bar has a central portion adapted to engage an upper edge of an edge lift anchor and, at each side of the central portion, a first portion which extends downwardly from the central portion and a second portion which extends upwardly and outwardly from the first portion and said second portion extends into a third portion extending substantially horizontally outwardly.

* * * * *